US005160805A

United States Patent [19]

Winter

[11] Patent Number: 5,160,805

[45] Date of Patent: Nov. 3, 1992

[54] PROJECTILE

[76] Inventor: Udo Winter, Wallnerstr 14, A-4020 Linz, Austria

[21] Appl. No.: 613,675

[22] PCT Filed: Jul. 26, 1989

[86] PCT No.: PCT/AT89/00066

§ 371 Date: Jan. 22, 1991

§ 102(e) Date: Jan. 22, 1991

[87] PCT Pub. No.: WO90/01669

PCT Pub. Date: Feb. 22, 1990

[30] Foreign Application Priority Data

Aug. 2, 1988 [AT] Austria ..... 1947/88

[51] Int. Cl.[5] ..... F42B 12/06; F42B 12/34; F42B 12/78

[52] U.S. Cl. ..... 102/518; 102/507; 102/514

[58] Field of Search ..... 102/398, 501, 507–510, 102/514–519

[56] References Cited

U.S. PATENT DOCUMENTS

| | | | |
|---|---|---|---|
| 1,316,917 | 9/1919 | Montero | 102/398 |
| 1,384,841 | 7/1921 | Lundell | 102/398 |
| 2,321,344 | 6/1943 | Whipple | 102/509 |
| 3,143,966 | 8/1964 | Burns, Jr. et al. | 107/507 |
| 4,136,616 | 1/1979 | Schirneker | 102/517 |
| 4,336,756 | 6/1982 | Schreiber | 102/516 |
| 4,819,563 | 4/1989 | Bodet | 102/501 |

FOREIGN PATENT DOCUMENTS

| | | | |
|---|---|---|---|
| 310723 | 4/1989 | European Pat. Off. . | |
| 197205 | 4/1908 | Fed. Rep. of Germany | 102/517 |
| 211778 | 7/1909 | Fed. Rep. of Germany . | |
| 330554 | 8/1903 | France . | |
| 2321108 | 3/1977 | France . | |
| 2502323 | 9/1982 | France . | |
| 2551196 | 3/1985 | France . | |
| 10770 | 7/1895 | Switzerland . | |
| 5960 | of 1885 | United Kingdom | 102/519 |
| 1605224 | 10/1984 | United Kingdom . | |

*Primary Examiner*—Harold J. Tudor
*Attorney, Agent, or Firm*—Collard & Roe

[57] ABSTRACT

A projectile (1) for a cartridge for hand-held firearms comprises a core (2) and a core jacket (3). The core (2) is made of a material which has a higher specific gravity than the material of the jacket (3). The core (2) and the jacket (3) are positively interconnected.

In order to achieve a high penetrating power and a man-stopping effect and to ensure that the trajectory will be relatively short in case of a miss, the core (2) of the projectile is integrally formed on its periphery with deformed portions (6), which extend radially outwardly within a diameter range which is determined by the maximum core diameter and serve to establish a positive joint with the core jacket (3), and in a manner known per se the core jacket (3) is open toward the tip of the projectile.

8 Claims, 3 Drawing Sheets

PROJECTILE

Figure 1:
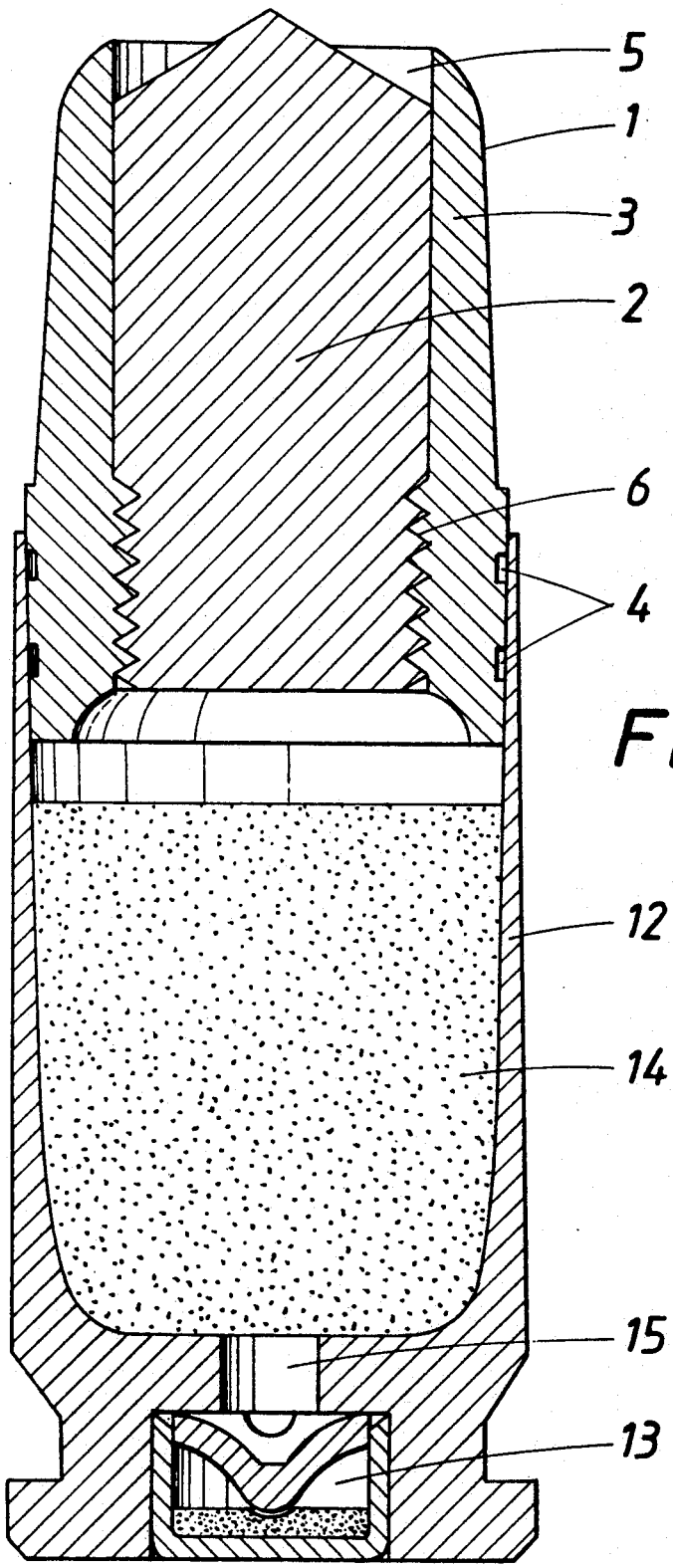

This invention relates to a projectile for a cartridge for the hand-held firearms, comprising a core and a core jacket, wherein said core consists of a material which has a higher specific gravity than the material of the jacket and the core and jacket are positively interconnected.

Projectiles having a jacketed core are available in various embodiments. In most cases the core is entirely enclosed by the jacket, which is intended to improve the sliding properties of the projectile in the barrel and to reduce the wear of the barrel and the deposition of material in the barrel (U.S. Pat. No. 1,502,925 and 2,926,612 and French patent Specification 2,429,407). Similar remarks are applicable to projectiles having a very hard core, which has an enlarged tip and is provided with a jacket bushing, which encloses the core with the exception of its tip and is closed at the bottom (French Patent Specification 2,431,676). It is also known to provide in shrapnel projectiles a multiplicity of core particles in a plastic sheath so that the core is held together (U.S. Pat. No. 4,649,829), and projectiles are also known which have a composite screwable core jacket and a specific core, which is reinforced by a closely fitting sleeve. In that case the provision of the core sleeve and the fact that the core is gripped by the jacket elements which have been screwed together are intended to prevent a premature disintegration of the core as it impinges on a target so that the effect of the projectile will correspondingly be increased (Swiss Patent Specification 305,151). In order to achieve a more uniform effect of the projectile on targets spaced at different ranges, projectiles are also known which comprise two cores, which have been inserted one behind the other into an outer jacket, and the rear core is additionally enclosed in a caplike inner jacket so that the impact of the projectile will cause the forward portion to be upset and the rear core will thus be radially expanded to a particularly large extent whereas the parts of the projectile will not be disintegrated and the shock action will be increased (East German Patent Specification 250,986).

With other projectiles which are of the kind described first hereinbefore and have been proposed a specific influence on the effect of the shot is achieved in that the core of the projectile and the core jacket are adapted to each other (French Patent Specification 2,321,108 and 2,497,940). For instance, in the projectile disclosed in French Patent Specification 2,321,108 the provision of a shoulder which radially protrudes over the maximum core diameter results in a strong positive joint between the core and the jacket and the projectile will act like an integral projectile as it impinges and in that case the jacket, which is closed at its tip only by a thin cap, will break inwardly and the entire material from the tip region will be laterally thrown away. This will result in a rapid dissipation of energy and in a good shock action or man-stopping effect. But the ability to penetrate is not satisfactory. On the other hand, in the projectile disclosed in Published French Application 2,497,940 the core and the jacket, which entirely encloses the core with the exception of the bottom, are interconnected only by a slightly upset portion at the bottom end of the jacket so that upon an impact the core will immediately pierce the thin layer of the jacket and only the core will penetrate the target and, as a result, the desired penetrating power but only a weak shock and man-stopping effect will be achieved.

Projectiles expected to have a high penetrating power have previously been made of a material having a high specific gravity and have been propelled by a high-explosive propellent. For this reason such projectiles combine a high penetrating power and large ranges so that in case of a miss such projectile will result in an uncontrolled danger to third persons even at a large distance and such projectiles cannot be used in police operations or the like. In a police operation or the like it will be desirable to use projectiles having a strong man-stopping effect and when they miss the target will involve a danger only within a small range. Besides, a relatively high penetrating power is desired so that conventional armor, which can resist projectiles of hand-held firearms, can be penetrated. But the known projectiles meet said requirements only in part and for this reason their use particularly in police operations is often unsatisfactory.

For this reason it is an object of the invention to provide a projectile which is of the kind described hereinbefore and which is most satisfactory as regards the mutually opposing requirements calling for a high penetrating power and a strong man-stopping effect and for a relatively short trajectory when the target is missed.

The object is accomplished by the invention in that the jacketed core is integrally formed on its periphery with deformed portions, which extend radially outwardly within a diameter range which is determined by the maximum core diameter and serve to establish a positive joint with the core jacket, and in a manner known per se the core jacket is open toward the tip of the projectile. Owing to that specific positive joint between the core and the jacket the core and the jacket are sufficiently firmly held together so that they will not be separated upon an impact on soft or plastically deformable target media and a joint penetration will be ensured. Within the target medium the jacket will be expanded and curled so that the desired man-stopping effect will be achieved. On the other hand, the positive joint is not so strong that it will resist an impact also on hard target media so that only the heavy core of the projectile will penetrate into hard target media and the desired penetration will be achieved. The fact that the core jacket is open at the front end will facilitate the curling of the jacket in soft target media and the stripping of the jacket upon an impact on hard target media.

If the deformed portions of the core consist of at least three peripheral grooves on the bottom portion of the core, which grooves may merge like screw threads, a positive joint having a desired strength can economically be established and said strength can be influenced by the selection of the number of grooves, the depth of the grooves, the profile of the grooves, and the like.

A desirable further feature of the invention resides in that the tip of the core of the projectile protrudes from the core jacket and the cylindrical core jacket may axially protrude beyond the cylindrical portion of the core of the projectile, which cylindrical portion merges into a conical tip portion, or the forward end face of the core jacket may adjoin and be flush with the envelope of the tip of the core. In that case an adaptation of the projectile to specific circumstances and an optimum effect of the projectile may be achieved in that the core protrudes to a larger or smaller extent, the size of a clearance space between the core and the jacket is properly selected, the tip of the projectile is properly designed, and the like.

In accordance with the invention the core jacket may be provided with axially extending rated break points so that the curling of the jacket in a soft target medium will be facilitated and the man-stopping effect will be increased.

The subject matter of the invention is shown more in detail in the drawing in which FIG. 1 is an axial sectional view showing a cartridge for hand-held firearms, which cartridge comprises a projectile in accordance with the invention, and FIGS. 2 to 5 are axial sectional views showing illustrative embodiments of the projectile in accordance with the invention.

A projectile 1 for a cartridge for hand-held firearms comprises a core 2 and a core jacket 3. The core 2 consists of a material which has a higher specific gravity than the material of the jacket 3. The core jacket 3 has been deformed adjacent to its bottom on its outside peripheral surface to have grooves 4 for ensuring a tight fit in the barrel of the weapon as the shot is fired. This may alternatively be achieved by sealing rings or sealing caps tightly fitted on the core jacket. The core 2 of the projectile and the core jacket 3 are positively interconnected by means of deformed portions 6, which are provided on the core 2 of the projectile within a diameter range that is determined by the maximum core diameter. Said deformed portions 6 are constituted by a plurality of equally spaced apart grooves or screw threads and ensure that the core and jacket will be held together as desired.

The projectile 1 is seated in a conventional cartridge case 12, which is provided with a primer cap 13 and has a powder chamber 14 for receiving the propellent charge. A vent 15 between the primer cup 13 and the power chamber 14 permits the propellent charge to be fired.

The tip of the core 2 of the projectile protrudes beyond the core jacket 3. As in the illustrative embodiment shown in FIG. 1 the core jacket 3 may axially extend beyond the cylindrical portion of the core 2 of the projectile so that there is an annular clearance 5 between the conical tip portion of the projectile 2 and the core jacket 3.

Figure 3:
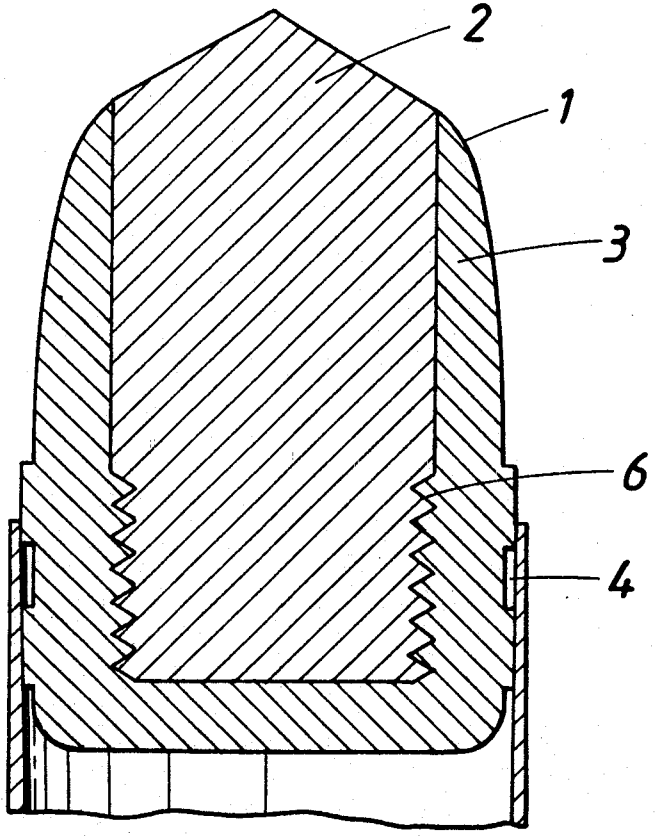
Figure 2:
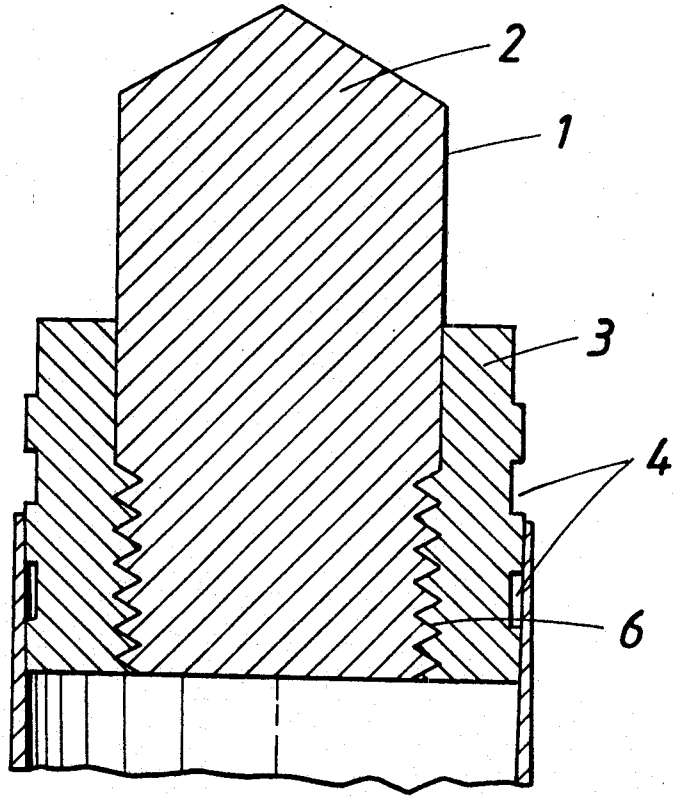

In the illustrative embodiment shown in FIG. 2 the core 2 of the projectile may protrude from the core jacket 3 not only with the tip but also with a part of the cylindrical portion of the core. As is shown in FIG. 3 the top end face of the core jacket 3 may adjoin and be flush with the envelope of the tip of the core. As is also indicated in the illustrative embodiment shown in FIG. 3 the core jacket 3 may be closed at the bottom and this will not adversely affect the effect of the projectile. From the illustrative embodiment shown in FIG. 4 it is apparent that the tip of the core 2 of the projectile may have any desired shape, such as a blunt shape.

Figure 5:
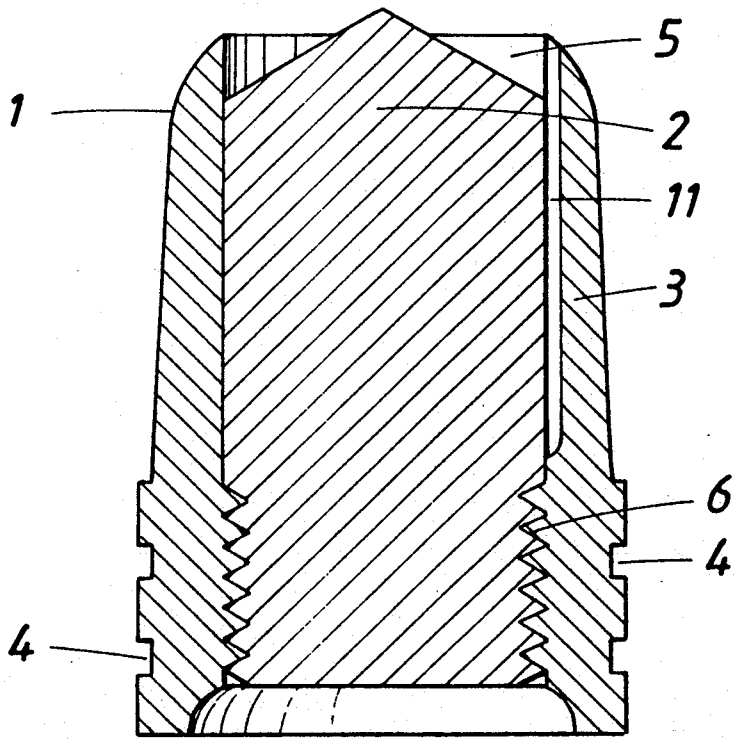
Figure 4:
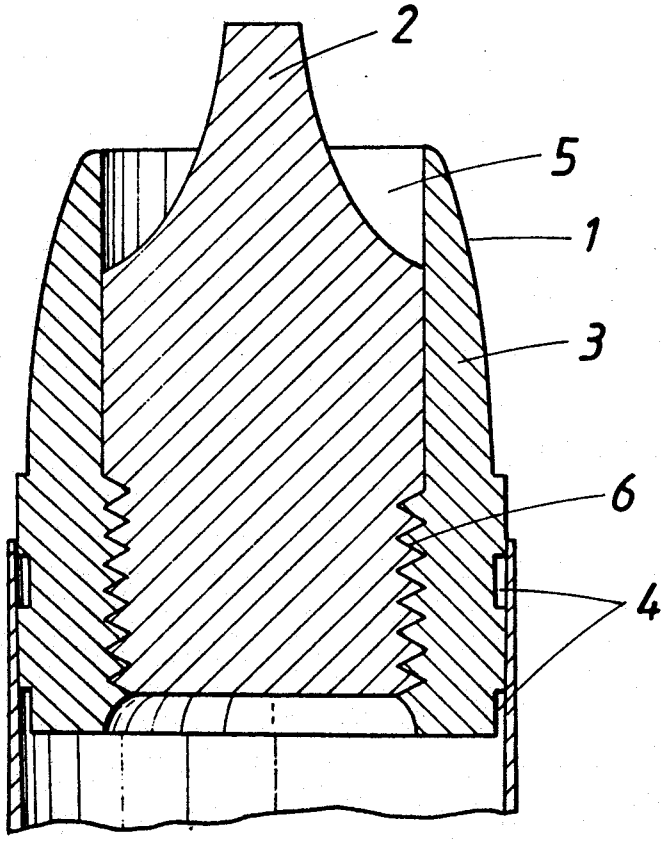

In the illustrative embodiment shown in FIG. 5 the core jacket 3 is formed with rated break points 11 consisting of axially extending grooves, which are symmetrically arranged and extend from the top rim of the jacket into the region of the positive joint 6.

As a projectile in accordance with the invention is fired, the discharge proper until the projectile leaves the barrel of the weapon will be effected as in the case of a conventional projectile and the essential difference from ammunition of the conventional kinds will only become apparent from the action of the projectile as it impinges on hard or soft target media.

When a projectile in accordance with the invention impinges on a hard target medium, such as a steel plate, the core 2 of the projectile will penetrate into the steel plate because the core will displace the material which is directly ahead of the tip of the core. At the same time, the core jacket 3 will be deformed on the surface of the steel plate and its diameter will centrally be increased around the point of impact of the core 2 of the projectile as said core 2 penetrates further into the steel plate. After a penetration to a defined depth the positive joint 6 between the core 2 and the core jacket 3 will be separated and the core 2 of the projectile, which core has now been separated from the core jacket 3, will proceed alone through the steel plate so as to displace portions of the target medium and to push portions of the target medium ahead of the core. Shortly before the ultimate penetration the material which is pushed ahead by the core will be punched in the shape of a cylindrical cup out of the steel plate. Thereafter the core 2 of the projectile and the cup which has been punched out will continue to proceed along their trajectory behind the steel plate with a residual energy and at a residual velocity. The core jacket 3 will stick to that surface of the steel plate which faces the muzzle or will fall to the ground.

For a comparison, the same steel plate was fired upon with commercially available ammunition having the same caliber. The projectile weighed about 8 grams. The projectile in accordance with the invention which was used in that test had a weight of 2.3 g. The impact of the commercially available projectile on the steel plate did not produce an effect or produced only a slight effect. On the other hand, a full penetration with a residual action behind the plate was effected by the projectile in accordance with the invention.

Upon an impact of a projectile 1 in accordance with the invention on a block of plastically deformable alumina or on another soft target medium, sad projectile will penetrate inot the plastically deformable target medium. As the depth of penetration increases, the core jacket 3 will be deformed in such a manner that it will first be expanded throughout its periphery and will separate from the top portion of the core 2 of the projectile and as the depth of penetration increases the core jacket 3 will be curled toward the rear end of the projectile. A clearance space 5 near the top will promote the expanding and curling of the core jacket 3 of the projectile opposite to the firing direction and as a result of that expanding and curling more energy will be dissipated from the projectile in the plastically deformable target medium. A difference from the impact on hard target media resides in that the positive joint 6 between the core jacket 3 and the core 2 of the projectile will not be separated upon an impact on hard target media but in that case the undeformed core 2 of the projectile and the strongly deformed core jacket 3 will form a unit and owing to the deformation of the core jacket 3 the energy will be more rapidly transferred from the projectile 1 to the plastically deformable target fluid than from comparable projectiles and the projectile will come to a standstill after a relatively short penetration.

If the core jacket 3 is provided with three or more rated break points 11, the core jacket 3 will be torn open along the rated break points 11 and as the depth of penetration increases segmentlike portions of the core jacket 3 will be curled opposite to the firing direction so that the diameter of the projectile 1 will be increased further.

It will be understood that the invention is not restricted to the illustrative embodiments which are shown but permits various materials to be used for the core of the projectile, such as steel, hard metal, tungsten and the like for the core of the projectile and such as aluminum, aluminum alloys, plastics and the like for the core jacket. For an easy action on the barrel of the weapon the core jacket may be provided entirely or in part with a protecting layer of copper, plastic or the like.

I claim:

1. A projectile for a cartridge for a hand-held firearm having a barrel of a predetermined caliber, the projectile comprising a core having a maximum diameter, and a jacket surrounding the core and having an outer surface of a diameter corresponding to the caliber, an inner surface of a diameter corresponding to the maximum core diameter and an open forward outer end opposite the cartridge, the core having a tip extending freely through the open jacket end, the core consisting of a hard material and the jacket consisting of a material softer than the core material, the core material having a higher specific gravity than the jacket material, and the core having deformed peripheral portions extending radially outwardly to an extent substantially equal to the maximum core diameter and into the inner jacket surface to establish a positive joint means between the core and the jacket, the positive joint means being firm enough to hold the core and jacket together upon impact on a softer target but not strong enough to resist an impact on a hard target.

2. The projectile of claim 1, wherein the positive joint means extends over a minor axial portion of the core.

3. The projectile of claim 2, wherein the deformed peripheral core portions define at least three peripheral grooves at a bottom end portion of the core opposite the tip.

4. The projectile of claim 3, wherein the deformed peripheral core portions are screw threads.

5. The projectile of claim 1, wherein the tip of the core protrudes from the center of the open-ended jacket.

6. The projectile of claim 5, wherein the core has a cylindrical portion axially adjoining the deformed core portions, and the tip is a conical portion axially adjoining the cylindrical core portion..

7. The projectile of claim 5, wherein the core has a cylindrical portion axially adjoining the deformed core portions, the cylindrical core portion having an outer end flush with the open end of the jacket, and the tip is a conical portion axially adjoining the cylindrical core portion.

8. The projectile of claim 2, wherein the inner jacket surface defines three axially extending grooves extending from the positive joint means to the open end.

* * * * *